United States Patent [19]

Smith et al.

[11] Patent Number: 4,576,313

[45] Date of Patent: Mar. 18, 1986

[54] FLUID REFILL POUCH AND DISPENSER

[75] Inventors: Randel P. Smith; Robert L. Steiner, both of Chicago, Ill.

[73] Assignee: Steiner Corporation, Salt Lake City, Utah

[21] Appl. No.: 146,641

[22] Filed: May 8, 1980

[51] Int. Cl.[4] ..... B65D 17/42

[52] U.S. Cl. ..... 222/81; 141/18; 141/330

[58] Field of Search ..... 222/80, 81, 83, 83.5, 222/87–91, 107; 141/18, 114, 329, 330; 206/603; 220/267, 277, 278

[56] References Cited

U.S. PATENT DOCUMENTS

| | | | |
|---|---|---|---|
| 2,849,321 | 8/1958 | Lhermitte et al. | 206/603 X |
| 3,128,913 | 4/1964 | Specketer | 222/107 |
| 3,220,588 | 11/1965 | Lipari | 206/222 |
| 3,255,923 | 6/1966 | Soto | 222/80 |
| 3,257,036 | 6/1966 | Micallef | 222/464 X |
| 3,596,801 | 8/1971 | Barnack | 222/81 |
| 3,768,697 | 10/1973 | Lerner | 222/80 |
| 3,792,799 | 2/1974 | Henfrey | 222/90 X |
| 3,884,387 | 5/1975 | Vannucci | 222/83 |
| 3,902,489 | 9/1975 | Carter | 222/83 X |
| 3,995,773 | 12/1976 | Schmit | 222/91 |
| 4,018,363 | 4/1977 | Cassia | 222/80 |
| 4,149,573 | 4/1979 | Cassia | 141/18 |
| 4,150,673 | 4/1979 | Watt | 222/80 X |
| 4,173,858 | 11/1979 | Cassia | 141/18 X |

*Primary Examiner*—F. J. Bartuska

*Attorney, Agent, or Firm*—Emrich & Dithmar

[57] ABSTRACT

A fluid refill pouch for use with a dispenser having a refill well with a refill opening therein and a piercing member disposed in the refill well, the pouch having a flexible wall hermetically sealed for containing fluid, and a docking adaptor loosely disposed in the pouch for insertion into the refill well so as to push the wall of the pouch upon the piercing member to pierce the wall and provide an opening for discharge of fluid from the pouch through the refill opening and into the dispenser; the inner wall of the refill well and the outer wall of the docking adaptor are shaped complementarily with flutes in the outer wall of the docking adaptor for easy grasping by the user, the parts having non-standard dimensions to provide anti-bootleg protection; there also is provided a fluid dispensing system incorporating such a refill pouch and dispenser.

48 Claims, 10 Drawing Figures

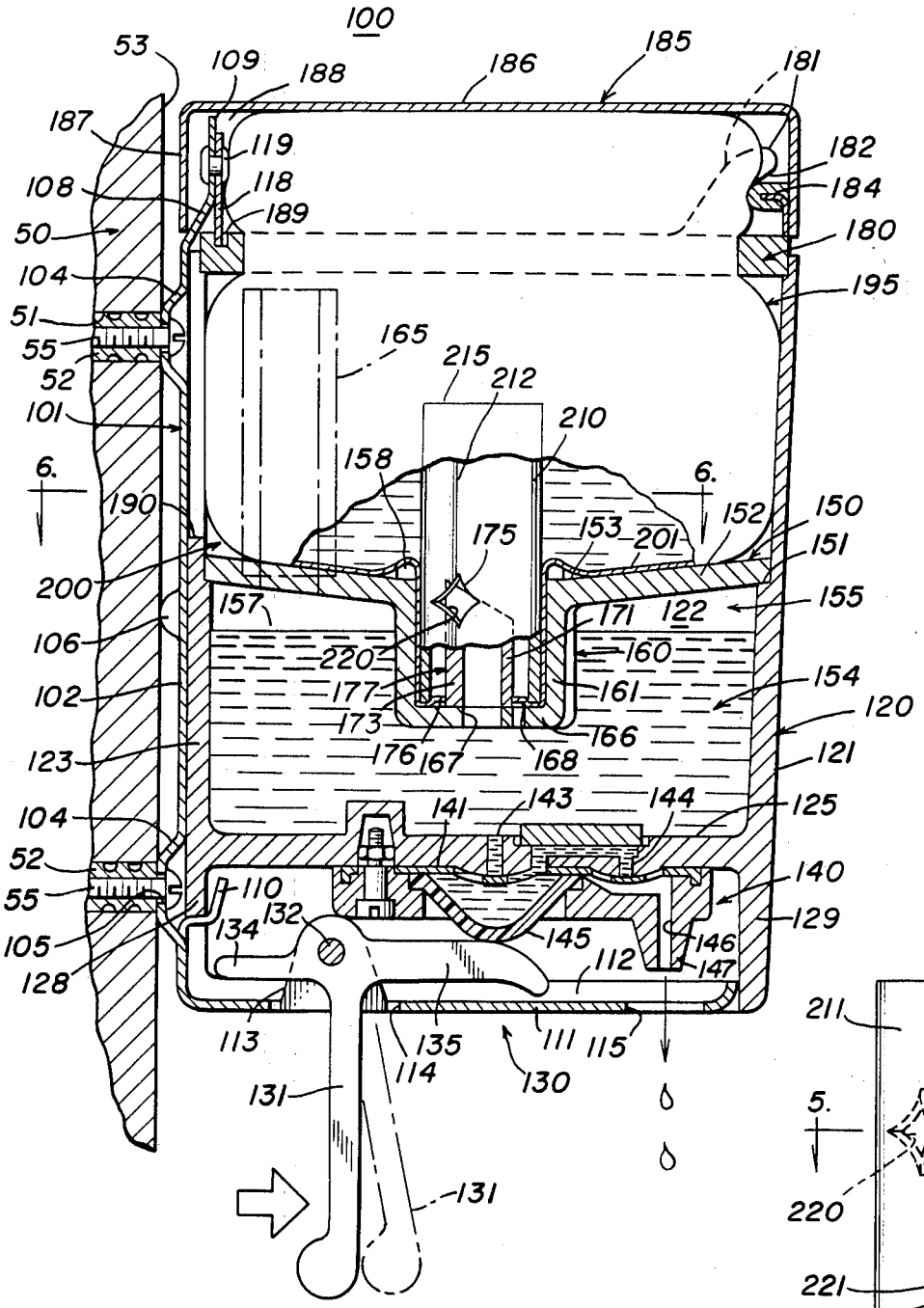
FIG. 3
FIG. 4
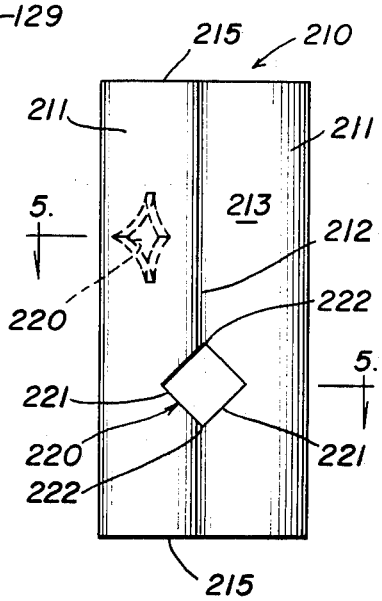
FIG. 5
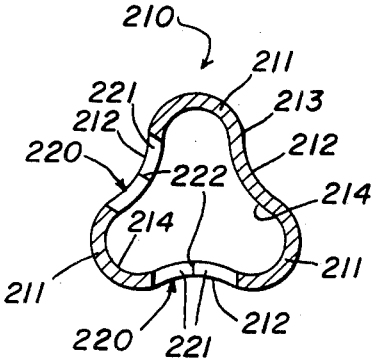

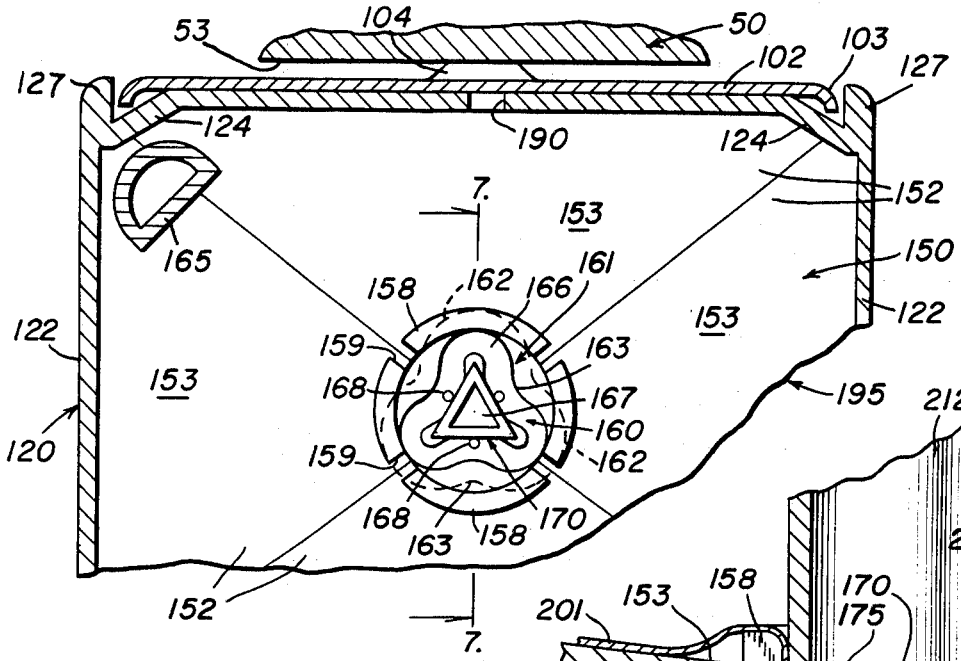
FIG. 6
FIG. 7
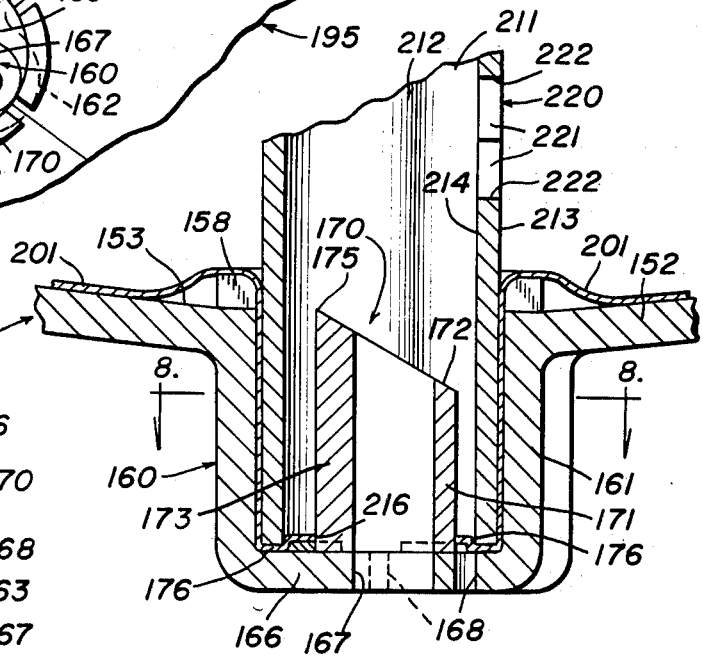
FIG. 8
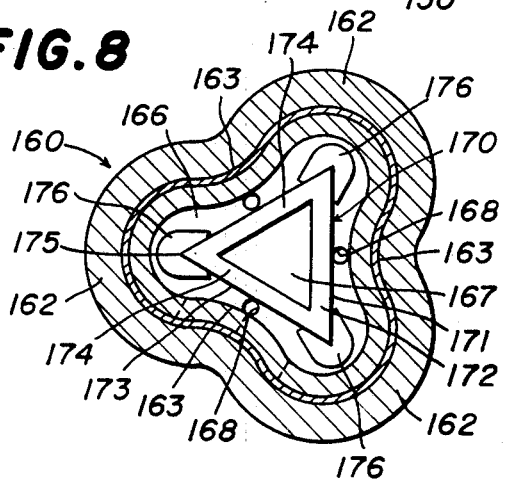
FIG. 9
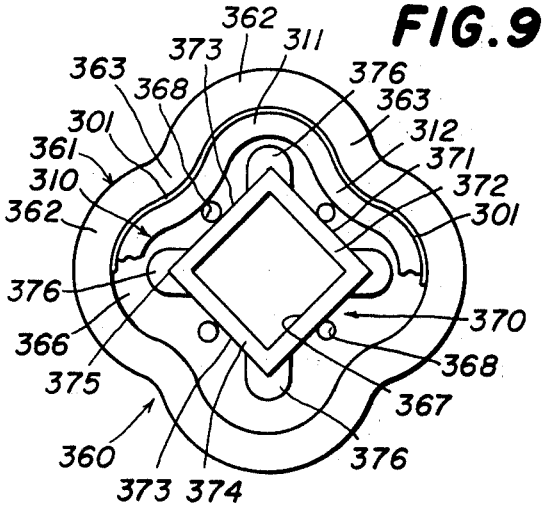
FIG. 10
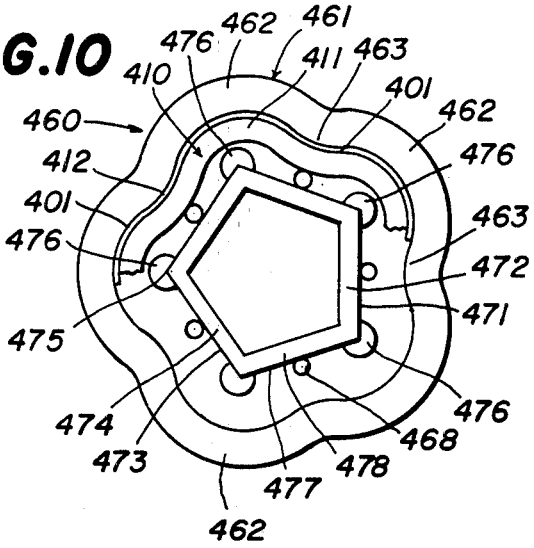

FLUID REFILL POUCH AND DISPENSER

BACKGROUND OF THE INVENTION

The present invention relates generally to an improved fluid refill pouch for refilling a refillable fluid dispenser and to dispensing systems incorporating such a pouch and dispenser. More particularly, there is disclosed an improved soap refill pouch for refilling liquid soap dispensers and soap dispensing systems incorporating such a pouch and dispenser.

This invention is an improvement upon the soap dispensing system disclosed and claimed in an application for U.S. Patent, Ser. No. 10,013 filed February 7, 1979 now U.S. Pat. No. 4,322,019 by R. P. Smith for Fluid Injection Pouch and Dispensing System Incorporating the Same, the disclosure of that prior application being incorporated herein in its entirety by reference. The present invention also is an improvement upon the soap dispensers and refill systems therefor disclosed and claimed in U.S. Pat. Nos. 4,018,363 granted April 19, 1977 to A. M. Cassia, 4,149,573 granted April 17, 1979 to A. M. Cassia, and 4,173,858 granted November 13, 1979 to A. M. Cassia. U.S. Pat. Nos. 4,149,573 and 4,173,858 both show cylindrical containers for liquid soap useful in refilling the soap container of a soap dispenser, and U.S. Pat. No. 4,018,363 also shows a cylindrical soap container that is incorporated into a soap dispenser to provide liquid soap therefor. Being cylindrical in configuration, the prior liquid soap refill structures are relatively expensive to fabricate and use and also are not economical in the use of storage space during the storage thereof.

The dispenser of the present application is an improvement upon the dispenser disclosed and claimed in the application for U.S. Patent, Ser. No. 150,556, filed May 16, 1980, now U.S. Pat. No. 4,345,627, corresponding to Italian Patent Application No. 19,346A/80 filed January 21, 1980 by A. M. Cassia for Soap Dispensing System. The present invention provides an improved refill well structure as compared to that of this pending patent application.

There also have been provided heretofore flexible pouches with puncture structure therein and typical structures are shown in U.S. Pat. Nos. 2,849,321 granted August 26, 1958 to Y. Lhermitte et al., 3,220,558 granted November 30, 1965 to M. Lipari, 3,255,923 granted June 14, 1966 to R. H. Soto, and 3,596,801 granted August 3, 1971 to H. C. Barnack. All of these prior pouch systems show a puncture structure disposed within the pouch, rather than a non-puncturing docking adaptor to be used with an external puncturing structure as in the present invention. All of the prior puncture structures within the pouch are essentially circular in cross section and are difficult for a user to handle through the flexible pouch wall, particularly when the pouch contains slippery liquid soap. In addition, there is no showing of any drainage structure in the puncture elements of the prior patents nor are there any suggestions of anti-bootleg structure in the prior patents, all of which are found in the refill bag of the present invention.

BRIEF SUMMARY OF THE INVENTION

The present invention provides a fluid refill pouch for use with a refillable fluid dispenser in a fluid dispensing system, and particularly a pouch and dispenser and system useful in dispensing liquid soap. The refill pouch is specifically designed and adapted to be economical in storage space during the storage thereof and having a docking adaptor therein which will not inadvertently puncture the wall of the pouch to release the contents thereof, which docking adaptor has flutes therealong to facilitate grasping by a user, drain openings therein to assure full drainage of the contents of the pouch into the associated dispenser, and non-standard dimensions that impart an anti-bootleg characteristic to the pouch and docking adaptor. The dispenser of the present invention includes a novel refill well that includes a piercing member cooperating with the docking adaptor in the pouch and fitting snugly therewith and being of non-standard dimensions so as to provide anti-bootleq protection for the dispenser, and thus to ensure only that authorized refill pouches are utilized in the dispensing system.

This is accomplished in the present invention, and it is an object of the present invention to accomplish these desired results, by providing a fluid refill pouch including a flexible encompassing wall sealed to form a hollow flexible container with a quantity of fluid therein, a hollow and generally cylindrical docking adaptor loosely disposed within the pouch, the docking adaptor including a generally cylindrical wall having an outer generally cylindrical surface and an inner generally cylindrical surface, and a plurality of longitudinally extending flutes in the outer surface of the docking adaptor, the flexible encompassing wall being foldable about the docking adaptor to permit a user to grasp the docking adaptor in the flutes to press one end of the docking adaptor against an area of the flexible encompassing wall.

Another object of the invention is to provide a fluid refill pouch of the type set forth wherein the ends of the docking adaptor are blunt and non-piercing with respect to the flexible encompassing wall.

Yet another object of the invention is to provide a fluid refill pouch of the type set forth wherein the docking adaptor outer surface is formed by three foils joined at the edges thereof to provide flutes extending longitudinally of the docking adaptor.

Still another object of the invention is to provide a fluid refill pouch of the type set forth wherein the docking adaptor outer surface is formed by four foils joined at the edges thereof, or in the alternative is formed by five foils joined at the edges thereof, to provide flutes extending longitudinally of the docking adaptor.

Yet another object of the invention is to provide a refillable fluid dispenser having a closed wall structure defining a vessel, partition means separating the vessel into a lower fluid reservoir and an upper refill compartment, dispensing means carried by the vessel for dispensing fluid from the reservoir, a refill well extending from the partition means into the reservoir and having a side wall and an inner wall closing the end of the side wall extending into the reservoir, and a piercing member carried by the inner wall and projecting therefrom into the refill well, the inner wall having a refill aperture therethrough providing direct communication between the reservoir and the refill compartment, the inner surface of the side wall having a plurality of longitudinally extending projections thereon extending inwardly toward the associated piercing member and being spaced therefrom a predetermined distance.

Still another object of the invention is to provide a refillable fluid dispenser of the type set forth wherein the piercing member is a hollow regular polygon in cross section with the outer end inclined at an angle with respect to the longitudinal axis thereof and terminating at an intersection of two of the walls of the piercing member.

Yet another object of the invention is to provide a refillable fluid dispenser of the type set forth wherein the inner surface of the side wall defining the refill well is formed by three foils joined at the edges thereof to provide longitudinal projections extending inwardly toward the associated piercing member and being spaced therefrom a predetermined distance, or in the alternative the inner surfaces of the side walls are formed by four or five foils so joined at the edges thereof.

In connection with the foregoing object, another object of the invention is to provide a refillable fluid dispenser wherein the piercing member has a cross section of a regular polygon with the number of sides equal to the number of foils in the side wall of the associated refill well.

A further object of the invention is to provide a fluid dispensing system which incorporates therein a fluid refill pouch and a refillable fluid dispenser of the type set forth hereinabove.

A still further object of the invention is to provide a fluid dispensing system of the type set forth wherein the inner surface of the side wall of the refill well and the cross section of the piercing member and the cross section of the docking adaptor are complementary so as closely to interfit one with the other, and all of the parts are of non-standard dimensions to provide anti-bootleg protection for the system.

Further features of the invention pertain to the particular arrangement of the parts of the refill pouch and the fluid dispenser and the fluid dispensing system incorporating the refill pouch and the fluid dispenser, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 3 is a view in vertical section taken along the line 3—3 in FIG. 1, and illustrating the internal construction of the fluid dispenser;

FIG. 4 is a side elevational view of a first form of a tubular docking adaptor forming a part of the fluid refill pouch of FIG. 2;

FIG. 5 is a view in horizontal section along the line 5—5 of FIG. 4;

FIG. 6 is a fragmentary view in horizontal section taken along the line 6—6 in FIG. 3;

FIG. 7 is an enlarged fragmentary view in vertical section through the refill well with the docking adaptor of a refill pouch in place, all as seen along the line 7—7 of FIG. 6;

FIG. 8 is a view in horizontal section along the line 8—8 of FIG. 7;

FIG. 9 is a view in horizontal section along the line 9—9 of FIG. 8 but showing a second form of refill well and cooperating docking adaptor in a refill pouch; and FIG. 10 is also a view in horizontal section similar to FIG. 8 and illustrating a third preferred form of refill well and docking adaptor in a refill pouch.

DETAILED DESCRIPTION OF THE PREFERRED EMBODIMENTS

Figure 1:
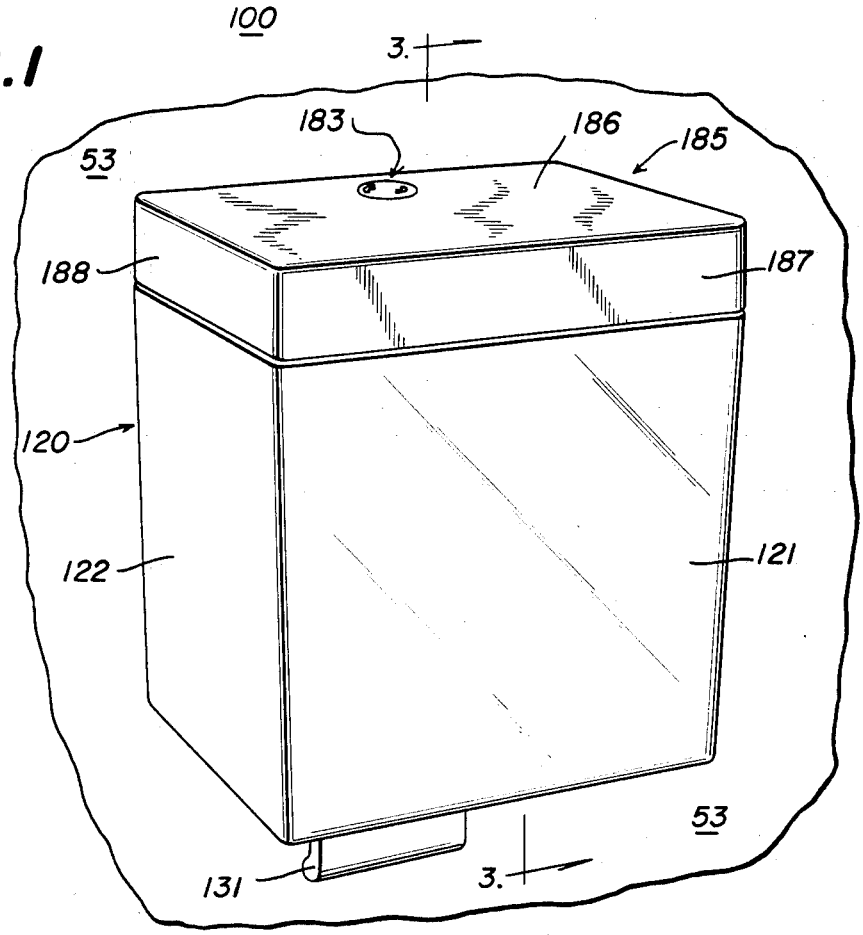
FIG. 1 is a front perspective view of a refillable fluid dispenser made in accordance with and embodying the principles of the present invention.

Referring to FIGS. 1, 3 and 6 of the drawings, there is illustrated a refillable fluid dispenser generally designated by the numeral 100, and specifically a refillable soap dispenser 100, constructed in accordance with and embodying the features of the present invention. The dispenser 100 is particularly designed and arranged to be refilled by a fluid refill pouch 200 of the present invention, the dispenser 100 and the pouch 200 cooperating to provide a novel fluid dispensing system, and specifically a novel soap dispensing system. Although liquid soap will be used for illustrative purposes to demonstrate a fluid useful for dispensing in the present invention, it will be understood that various other liquids and fluids can successfully be dispensed using the dispenser 100 and the refill pouch 200 of the present invention.

The details of construction and operation of the soap dispenser 100 are fully set forth in the copending application for U.S. Patent, Ser. No. 150,556, that corresponds to Italian Pat. Appln. No. 19,346A/80 referred to above, and the disclosure of that application is incorporated herein by reference.

The soap dispenser 100 includes a mounting bracket, generally designated by the numeral 101, which has a generally flat rectangular wall 102 disposed substantially vertically in use to provide a bearing surface, and having along each of the side edges thereof an integral curved side flange 103 which projects forwardly from the wall 102. Formed in the vertical wall 102 and projecting inwardly therefrom in a direction away from the direction in which the side flanges 103 extend, are two substantially vertically aligned frustoconical embossments 104, each having an opening 105 extending therethrough centrally thereof. Also formed in the wall 102 and projecting rearwardly therefrom are two embossments 106 (only one shown) which are disposed in substantial horizontal alignment with each other along a line disposed substantially midway between the embossments 104, with the embossments 106 projecting rearwardly the same distance as the embossments 104, and each having an opening (not shown) extending therethrough centrally thereof.

Integral with the wall 102 on the upper end thereof is an extension flange 108 which is inclined forwardly in the same general direction as the side flanges 103, and which is integral at the distal end thereof with an upwardly extending flange 109 which is substantially parallel to the wall 102. Punched from the wall 102 adjacent to the lower end thereof are two forwardly and upwardly inclined support flanges 110. Integral with the bottom end of the wall 102 and extending forwardly therefrom substantially normal thereto is a wall 111 which is disposed substantially horizontally and is provided around the periphery thereof with an integral upturned flange 112 which is in turn integral with the side flanges 103. Integral with the wall 101 and projecting upwardly therefrom substantially normal thereto are two parallel and laterally spaced-apart pivot brackets 113, a portion of the wall 111 between the pivot brackets 113 being cut out to define a generally rectangular opening 114. Formed in the wall 111 adjacent to the forward edge thereof and substantially midway between the side edges thereof is a circular soap discharge opening 115, the purpose of the openings 114 and 115 being described more fully hereinafter. A circular retaining plate 118 is pivotally secured to the inner surface of the upward extending flange 109 as by a rivet 119. In use, the mounting bracket 101 is mounted on a wall 50, generally above and closely adjacent to a sink, wash basin, or the like. Mounting openings or holes 51 are formed in the wall 50 and may have screw fastening inserts 52 set therein. The mounting bracket 101 is fixedly secured to the wall 50 by means of mounting screws 55 that pass through the openings in the embossments 104 and 106, respectively, and threadedly engage in the inserts 52, the wall 102 being disposed substantially parallel to the surface 53 of the wall 50, and being in contact therewith only at the embossments 104 and 106, which serve to space the mounting bracket 101 a slight distance from the surface 53 of the wall 50.

The soap dispenser 100 also includes a soap container, housing or vessel, generally designated by the numeral 120, which is preferably formed of a translucent or transparent plastic, although it is understood that any suitable material, either opaque or light-transmitting, could be used. The container 120 is generally box-like in configuration and includes a generally rectangular front wall 121, a pair of opposed side walls 122, a rear wall 123 and a rectangular bottom wall 125, the container 120 preferably being molded so that the walls 121, 122, 123 and 125 are all formed integrally with one another. The rear wall 123 is provided at the lateral side edges with inturned forwardly inclined portions 124. The side walls 122 have rearwardly extending portions 127 which project rearwardly beyond the rear wall 123, whereby the rear wall 123 is recessed with respect to the side walls 122. In addition, the rear wall 123 extends downwardly below the bottom wall 125 to form a downwardly extending portion or mounting flange 128. Similarly, the front wall 121 and the side walls 122 all extend downwardly well below the bottom wall 125 and below the bottom edge of the mounting flange 128 to form a skirt 129.

Mounted below the bottom wall 125 of the container 120 is a pump assembly, generally designated by the numeral 130. The operation and construction of the pump assemply 130 is described in detail in U.S. Pat. No. 4,018,363, issued April 19, 1977, and assigned to the assignee of the present invention, the disclosure of which patent is incorporated herein by reference. The pump assembly 130 includes an operating handle 131 provided with a pivot pin 132, the opposed ends of which are respectively mounted in the pivot brackets 113 on the mounting bracket wall 111 for pivotal movement of the operating handle 131 about the axis of the pivot pin 132, which extends substantially horizontally above the bracket wall 111 substantially parallel thereto and to the bracket wall 102. The handle 131 projects in use downwardly through the opening 114 in the bracket wall 111 and terminates at the lower end thereof in an enlarged gripping portion. The handle 131 also includes a stop member 134 which projects rearwardly from the pin 132 above the housing wall 111, and an acutating arm 135 which projects forwardly from the pin 132 above the bracket wall 111 and is substantially longer than the stop member 134.

The pump assembly 130 also includes a unitary pump housing 140, which is preferably of molded construction. The pump housing 140 is fixedly secured to the bottom wall 125 of the container 120 by suitable fasteners. Securely sandwiched between the pump housing 140 and the bottom wall 125 of the container 120 is a flexible diaphragm 141 having a plurality of suction apertures therethrough in surrounding relationship with a suction conduit or opening 143 in the bottom wall 125 of the container 120. The diaphragm 141 also has a plurality of discharge apertures therein disposed in surrounding relationship with a discharge conduit 144 in the bottom wall 125. A flexible resilient bowl 145 is disposed below the diaphragm 141 in the region of the suction conduit 143, the outer surface of the bowl 145 normally just touching the actuating arm 135 when the handle 131 is in its normal rest position illustrated by solid lines in FIG. 3. Disposed below the diaphragm 141 in the region of the discharge conduit 144 is a delivery conduit 146 and a spout 147 disposed immediately above and in alignment with the soap discharge opening 115 in the mounting bracket wall 111. A channel provides communication between the bowl 145 and the discharge conduit 144.

In operation, the soap container 120 is mounted on the mounting bracket 101 in a manner which is fully explained in the aforementioned U.S. Pat. No. 4,149,573, the disclosure of which is incorporated herein by reference. The operating handle 131 is pulled forwardly by a user thereby to compress the bowl 145 with the actuating arm 135 and expel a predetermined quantity of liquid soap from the delivery conduit 146, release of the operating handle 131 permitting re-expansion of the bowl 145 thereby to suck a fresh charge of liquid soap from the container 120 through the suction conduit 143 in preparation for the next dispensing operation, all as is more fully explained in the aforementioned U.S. Pat. Nos. 4,018,363 and 4,149,573.

There is provided in the soap container 120 a partition, generally designated by the numeral 150, which is disposed generally horizontally in use, the partition 150 being substantially rectangular in shape with the peripheral edges thereof resting upon a ledge 151 formed in the inner surfaces of the soap container walls 121–123 and fixedly secured thereto as by ultrasonic welding. The partition 150 comprises four generally triangular sectors 152, the upper surfaces 153 of which slope gently downwardly toward the center of the partition 150.

Disposed centrally of the partition 150 and extending downwardly therefrom is a refill well 160 incorporating the features of the present invention, the refill well 160 being a first preferred embodiment thereof. The refill well 160 includes a downwardly extending side wall 161 that is preferably integrally secured to the partition 150 and has a horizontal cross section as is best illustrated in FIG. 8. As is seen in FIG. 8, the side wall 161 is formed of three foils 162 that are part circular in shape and are joined along the longitudinal edges thereof to provide inwardly directed projections 163. The lower end of the refill well 160 is essentially closed by an inner or bottom wall 166 effectively filling the space defined by the side walls 161 and being integral therewith, a primary refill opening 167 being disposed centrally of the bottom wall 166 and being essentially triangular in shape. Three drain holes 163 are provided in the bottom wall 166 spaced from the refill opening 167 for a purpose to be discussed more fully hereinafter.

Disposed centrally of the bottom wall 166 and surrounding the refill opening 167 is an upstanding hollow piercing member 170. As is best seen in FIG. 8, the piercing member 170 is triangular in shape and has a first shorter side wall 171 disposed to the right in FIG. 7 and having an upper edge 172 thereon, and two higher side walls 173 each having one edge thereof integrally joined to the edges of the shorter side wall 177 and joined to each other at the other edges thereof, each of the higher side walls 173 having an upwardly inclined upper edge 174 that are joined at a piercing point 175 disposed to the left in FIGS. 7 and 8. Also mounted on the bottom wall 166 and extending upwardly therefrom at the corners of the piercing member 170 are abutments 176, three of the abutments 176 being provided, the abutments 176 preventing the full seating of an undersized docking adaptor and the refill bag 200 as will be described more fully hereinafter, whereby the abutments 176 serve as a part of the anti-bootleg structure of the present invention. It will be noted that the drain holes 168 are disposed essentially midway of the walls of the piercing member 170 and are disposed essentially thereagainst and opposite the inwardly extending projections 163 on the refill well side wall 161.

It will be seen that the partition 150 cooperates with the bottom wall 125 and the walls 121–123 in the container 120 to define therebetween a liquid soap reservoir, generally designated by the numeral 155, which is adapted to be filled with a quantity of liquid soap or other fluid 154 to a level 157, the position of the partition 150 in the soap container 120 being such that the reservoir 155 occupies slightly less than half of the interior volume of the container 120. Fixedly secured to the partition 150 adjacent to one corner thereof and extending vertically upwardly therefrom and terminating adjacent the upper end of the container 120 is a hollow vent tube 165, the lower end of which communicates with a vent opening formed through the partition 150. The vent tube 165 is generally semi-circular in transverse cross section, all as is best seen in FIG. 6. Integral with the upper surface 153 of the partition 150 around the upper perimeter of the refill well 160 is an annular rim 158 having notches 159 formed therein respectively at the junctions of the triangular sectors 152.

The container 120 is also provided with a top plate, generally designated by the numeral 180, the outer perimeter of which conforms to the perimeter of the upper edge of the container 120 and is adapted to be seated on a ledge formed in the inner surfaces of the container walls 121–123 and fixedly secured thereto as by ultrasonic welding. The top plate 180 has a large octagonal opening formed therein so that the top plate 180 essentially comprises a relatively narrow flange projecting horizontally inwardly from the walls of the container 120. Formed in the upper surface of the top plate 180 adjacent to the rear edge thereof is a shallow recess 189 adapted to receive therein the retaining plate 118 fixedly to hold the container 120 in place on the mounting bracket 101. Extending upwardly from the top plate 180 at the rear corners thereof are two rear abutments, while two forward abutments 181 respectively extend upwardly from the top plate 180 adjacent to the front corners thereof, the forward abutments 181 each having a notch 182 formed in the front surface thereof.

The container 120 is also provided with a cover plate, generally designated by the numeral 185, which includes a flat rectangular top wall 186, a pair of opposed side walls 187 and a pair of opposed end walls 188, all integrally connected in a unitary structure. Fixedly secured to the top wall 186 adjacent to the rear edge thereof is a key operated latch mechanism 183. Fixedly secured to the inner surface of the front side wall 187 is an elongated rearwardly extending finger 184, preferably covered with a resilient cushioning material, the finger being adapted to be received in the notches 182 in the forward abutments 181 of the top plate 180. The cover plate 185 is dimensioned so as completely to cover the top wall 186 of the container 120, with the walls 187–188 having a vertical extent sufficient to accommodate the inclined flange 108 and the upwardly extending flange 109 on the mounting bracket 101. In use, the finger 184 is inserted into the notches 182 of the forward abutments 181, and the cover plate 185 is then pivoted down into position completely covering the top of the container 120, as illustrated in FIG. 3, a latch hook of the latch mechanism 183 engaging in a complementary keeper opening (not shown) in the upwardly extending flange 109 of the mounting bracket 101.

Formed in the rear wall 123 of the container 120 is a vertical slot 190 which extends from just above the partition 150 to the top wall 180, for a purpose to be explained more fully below. It can be seen that the cover plate 185 cooperates with the partition 150 and the walls 121–123 of the container 120 to define a closed refill compartment generally designated by the numeral 195, communication between the refill compartment 195 and the liquid soap reservoir 55 being provided by the refill well 160 and the hollow vent tube 165.

Figure 2:
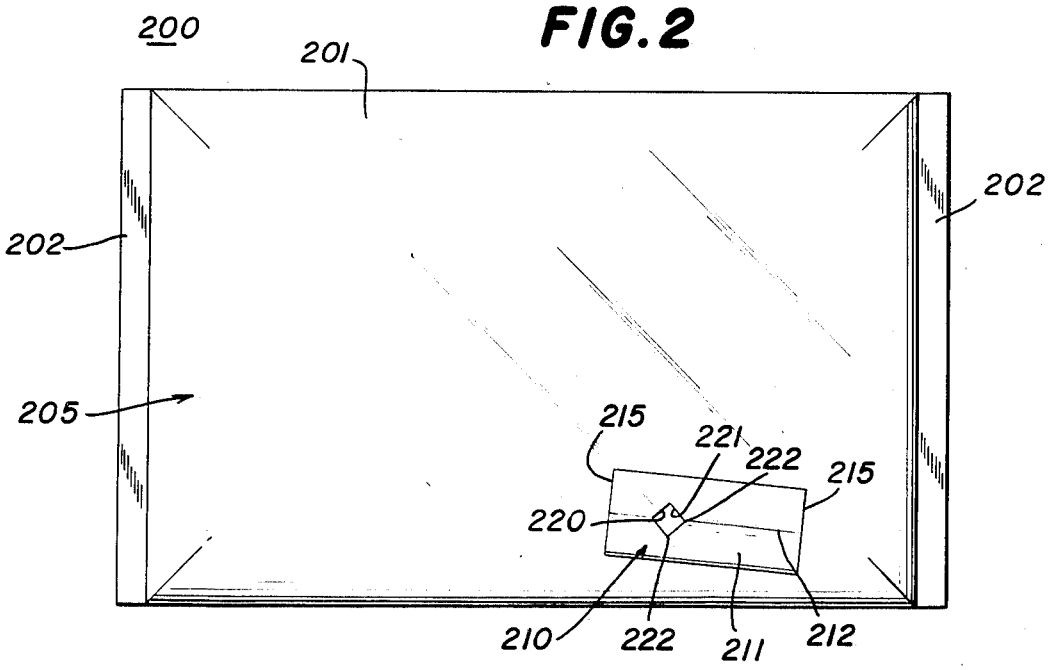
FIG. 2 is a plan view of a fluid refill pouch made in accordance with and embodying the principles of the present invention.

Referring to FIGS. 2, 3 and 7 of the drawings, there is illustrated a first form of a fluid refill pouch 200 for use with the soap dispenser 100 to provide a fluid dispensing system, the fluid refill pouch 200 more specifically being constructed and arranged to be inserted in the refill compartment 195 to replenish the supply of liquid soap 154 in the reservoir 155 through the refill well 160. The refill pouch 200 includes a flexible plastic wall 201 that is initially tubular in shape, other shapes being also useful, and which after filling with liquid soap 154, is sealed at each end as at 202 to provide a fluid-tight container 205 for liquid soap.

Disposed within the container 205 and in the fluid disposed therein, is a tubular docking adaptor 210, see particularly FIGS. 4, 5, 7 and 8. The docking adaptor 210 is hollow and includes a generally cylindrical wall having an outer generally cylindrical surface 213 and an inner generally cylindrical surface 214. The wall of the docking adaptor 210 in cross section is formed of three foils 211, each of the foils 211 being part circular in shape, and having the longitudinal edges thereof joined to provide flutes 212 extending longitudinally of the docking adaptor 210. The cross sectional shape and the size of the outer surface 213 are such as to fit within the refill well 160 which is complementarily shaped thereto on its inner surface, there being sufficient space between the refill well side wall 161 and the docking adaptor outer surface 213 to receive a section of the pouch wall 201 therebetween as is best seen in FIGS. 3, 7 and 8. The inner surface 214 is shaped complementary to the outer surface 213, i.e., the docking adaptor has a wall of uniform thickness, and the inner surface 214 is large enough to slip over the piercing member 170 and also to fit over the abutments 176 (see FIG. 8), whereby fully to seat the docking adaptor 210 within the refill well 160. The docking adaptor 210 has two ends 215 which are formed flat and normal to the longitudinal axis of the docking adaptor 210, the ends 215 being non-piercing with respect to the material of the wall 201 of the refill pouch 200.

There are provided in the docking adaptor 210 two diamond-shaped drain openings 220 which are spaced from the adjacent end 215 by an equal and predetermined distance. Each of the diamond-shaped openings 220 has four edges 221, two of the edges 221 providing an intersection at a point 222 that is disposed a predetermined distance from the adjacent end 215 of the adaptor 210. More specifically, the point 222 is disposed away from the adjacent adaptor end 215 a distance such that point 222 is disposed well below the upper surface 153 of the partition 150 adjacent to the refill well 160 when the parts are in the refill positions illustrated in FIG. 3. This arrangement of the drain openings 220 assures that the last portions of liquid soap in the pouch 200 can be drained into the reservoir 155 of the soap dispenser 100.

It is pointed out that the docking adaptor 210 is essentially symmetrical about a plane normal to the longitudinal axis of the docking adaptor 210 and intersecting the longitudinal midpoint of the docking adaptor 210. As a consequence, either of the ends 215 on the docking adaptor 210 may be inserted into the refill well 160. It also is noted that the drain openings 220 are circumferentially displaced with respect to each other and are disposed in one of the flutes 212, the circumferential displacement of the drain openings 220 with respect to each other strengthening the docking adaptor 210 as compared to a configuration wherein the drain openings 220 were in longitudinal alignment.

In a constructional example of the refill pouch 200, the wall 201 is formed of a plastic, a preferred plastic being polyethylene plastic, having a thickness of about 1.5 mils. The thickness of the plastic may vary from as little as 1 mil. up to as much as 5 mils. while retaining the desirable characteristics of the refill pouch 200. The portion of the wall 201 forming the container 205 is preferably about 6"×7', and the seals 202 are preferably about ⅛" wide. Other materials may be used in forming the walls 201, such as thin gauge metal, fluid-proof paper and the like. The tubular docking adaptor 210 also is preferably formed of plastic, a preferred plastic being polyethylene plastic. The length of the docking adaptor 210 is about 3" while the longitudinal point-to-point distance of the drain openings 220 in the longitudinal direction is about ½". The refill pouch 200 may be used to replenish all types of fluids, and is specifically not limited to use in replenishing liquid soap. Other suitable fluids useful in the present invention are automotive oils, windshield wiper fluid, medical fluids, industrial metal cutting lubricants, chemical additives, etc.

One of the important features of the present invention is the sizing of the inner surface of the side wall 161 of the refill well 160, and the relationship thereof to the shape and dimensions of the outer surface 213 and the inner surface 214 of the docking adaptor 210, and the shape and size of the piercing member 170. By a judicial selection of the size and shapes of these parts, it becomes difficult for unauthorized refill pouches 200 to be utilized in the dispenser 100. More specifically, the dimensions of these parts are chosen so as to be non-standard in character, i.e., so that the dimensions are not a multiple of 1/64" in the English system of measurement or a multiple of 0.01 mil. in the metric system of measurement. For example, if it is desired that the greatest dimension of the docking adaptor 210 in a transverse direction as viewed in FIG. 5 be in the general range of 0.75", it is proposed that this dimension be 0.773". The number "773" is a prime number disposed between "700" and "800", the latter two numbers when divided by a thousand giving the approximate desired dimension sought. Another prime number in the range is "733", but this number would not be chosen since when divided by a thousand it is so close to the nominal fraction 47/64. The choice number "773" is approximately half way between the nominal fraction 49/64 and 50/64, and is 19.634 mil. which is also not an even multiple of 0.01 mil. By so choosing non-standard dimensions in both the English and metric systems for the inner dimensions of the refill well 160, the outer dimensions of the piercing member 170 and the inner and outer dimensions of the docking adaptor 210, use of unauthorized refill pouches 200 in the dispenser 100 is strongly discouraged and provides so-called "anti-bootleg" protection for the dispenser 100.

In the use of the refill pouch 200 to provide the reserve supply of soap in the refill compartment 195, the user first removes the cover plate 185 by actuating the lock mechanism 183 to the unlocked position thereof. The exhausted prior refill pouch 200 is removed by the user grasping the tubular docking adaptor 210 through the wall 201 of the refill pouch 200, the user more particularly grasping the docking adaptor 210 in the flutes 212 thereof. By simply pulling the docking adaptor 210 upwardly, the entire exhausted refill pouch 200 can be readily removed from the refill compartment 195. Any soap remaining in the refill well quickly drains through the drain holes 168 and into the reservoir 155 if the level 157 is below the bottom wall 166. The user then grasps a filled refill pouch 200, and specifically grasps the tubular docking adaptor 210 in the flutes 212 thereof through the pouch walls 201, the docking adaptor 210 preferably being grasped adjacent to one end thereof with the adjacent portion of the wall 201 folded over the adjacent end 215. The other end 215 of the docking adaptor 210, i.e., the end disposed away from the grasp of the user, is then inserted into the refill well 160. The portion of the wall 201 covering the other end 215 is pressed against the piercing point 175 of the piercing member 170 to provide a pierced portion 206 in the wall 201, after which the docking adaptor 210 is firmly pushed to the fully seated position illustrated in FIGS. 3 and 7 of the drawings. The provision of the flutes 212 in the sides of the docking adaptor 210 facilitates ready grasping by a user despite the fact that it is within the wall 201 in a slippery liquid soap. It will be noted that the outer surface 213 of the docking adaptor 210 fits within the side wall 161 of the refill well 160 with the portion of the pouch wall 201 disposed therebetween. The piercing member 170 fits well within the docking adaptor 210 (see FIG. 8 particularly), and the docking adaptor 210 also fits over and is not impeded in its movement to the fully seated position by the abutments 176. It also is pointed out that the annular rim 158 eliminates the possibility of any sharp corners that might puncture the wall 201 of the refill pouch 200, while the notches 159 therethrough permit full drainage of fluid from the refill compartment 195 when desired.

With the parts in the positions illustrated in FIGS. 3, 7 and 8, the contents of the refill pouch 200 are free to flow through the docking adaptor 210, particularly the lower drain opening 220 thereof and then through the hollow piercing member 170 and the refill opening 167 into the reservoir 155, all as required by the level 157 within the reservoir 155. The refill pouch 200 is perfectly flexible, and therefore can easily be arranged within the refill compartment 195. The user then replaces the cover plate 185 on the dispenser 100 and preferably secures it in position by means of the lock mechanism 183.

It will be appreciated that the refill pouch 200 can be stored in a minumum of space, since the wall 201 thereof can be formed so as closely to pack in a container holding a plurality of the refill pouches 200. Furthermore, the docking adaptor 210 is disposed completely within the pouch 200 and the soap contained therein, whereby there is no objectionable protrusion which interferes with packing and storage of the refill pouch 200. Since the ends 215 of the docking adaptor 210 are flush and non-piercing with respect to the material of the wall 201, there will be no inadvertent puncturing of the wall 201 and the resultant messy outflow of stored fluids within the pouch 200 during storage and transportation thereof. In use, the construction of the refill pouch 200 and its docking adaptor 210 assure easy and tidy replenishing of the fluid in the dispenser 100. Since the refill pouch 200 and all the components thereof including the docking adaptor 210 are disposable, there is a minimum of difficulty experienced by the user in disposing of the empty refill pouch 200 and its associated parts.

Referring to FIG. 9 of the drawings, there is illustrated a second preferred embodiment of a refill well 360 having disposed therein a modified piercing member 370 and receiving a modified docking adaptor 310. As illustrated, the refill well 360 has a side wall 361 formed of four foils 362 that are part-circular in shape and are joined along the longitudinally extending edges thereof to provide projections 363 extending inwardly. A bottom wall 366 is provided essentially closing the lower end of the refill well 360 and having a refill opening 367 therein and four drain holes 368 disposed around the piercing member 370 and opposite the projections 363.

The piercing member 370 is hollow and surrounds the refill opening 367 and includes four side walls, two of the side walls 371 being shorter and being provided with upwardly inclined upper edges 372, and two of the side walls 373 being higher and having upwardly inclined upper edges 374. One of the longitudinal edges of the side walls 371 are joined to each other, and the other longitudinal edges of the side walls 371 are joined to one of the longitudinal edges of the higher side walls 373, the other longitudinal edges of the higher side walls 373 being joined and intersecting at a piercing point 375 disposed to the left in FIG. 9. It will be seen that the piercing member 370 is a regular polygon, more specifically, is a hollow square, abutments 376 being provided at each of the corners of the piercing member 370 and extending outwardly toward the associated foil 362 of the refill well 360.

The docking adaptor 310 of FIG. 9 is generally cylindrical in cross section and is formed of four foils 311 that are part-circular in shape and have the longitudinally extending edges thereof joined at flutes 312. The outer surface 313 has dimensions slightly less than those of the inner side wall 361 of the refill well 360 and is shaped complementarily thereto and fits therein with the refill pouch wall 301 disposed therebetween. The inner surface 314 of the docking adaptor 310 is spaced outwardly with respect to the abutments 376 so that the piercing member 370 is received easily within the docking adaptor 310. The refill well 360, the piercing member 370 and the docking adaptor 310 cooperate with each other in the same manner as do the refill well 160, the piercing member 170 and the docking adaptor 210 described above. Preferably, the refill well 360, the piercing member 370 and the docking adaptor 310 have non-standard dimensions of the type described above so as to provide anti-bootleg protection for the associated dispenser.

Referring to FIG. 10 of the drawings, there is illustrated a third preferred embodiment of a refill well 460 having disposed therein a modified piercing member 470 and receiving a modified docking adaptor 410. As illustrated, the refill well 460 has a side wall 461 formed of five foils 462 that are part-circular in shape and are joined along the longitudinally extending edges thereof to provide projections 463 extending inwardly. A bottom wall 466 is provided essentially closing the lower end of the refill well 460 and having a refill opening 467 therein and five drain holes 468 disposed around the piercing member 470 and opposite the projections 463.

The piercing member 470 is hollow and surrounds the refill opening 467 and includes five side walls, one of the side walls 471 being shorter and being provided with an upper edge 472, and two of the side walls 477 being higher and provided with upwardly inclined upper edges 478, and two of the side walls 473 being yet higher and having upwardly inclined upper edges 474. One of the longitudinal edges of the side wall 471 are joined each to one of the longitudinal edges of the side walls 477, and the other longitudinal edges of the side walls 477 are joined to one of the longitudinal edges of the yet higher side walls 473, the other longitudinal edges of the higher side walls 473 being joined and intersecting at a piercing point 475 disposed to the left in FIG. 10. It will be seen that the piercing member 470 is a regular polygon, more specifically, is a regular pentagon, abutments 476 being provided at each of the corners of the piercing member 470 and extending outwardly toward the associated foil 462 of the refill well 460.

The docking adaptor 410 of FIG. 10 is generally cylindrical in cross section and is formed of five foils 411 that are part-circular in shape and have the longitudinally extending edges thereof joined at flutes 412. The outer surface 413 has dimensions slightly less than those of the inner side wall 461 of the refill well 460 and is shaped complementarily thereto and fits therein with the refill pouch wall 401 disposed therebetween. The inner surface 414 of the docking adaptor 410 is spaced outwardly with respect to the abutments 476 so that the piercing member 470 is received easily within the docking adaptor 410. The refill well 460, the piercing member 470 and the docking adaptor 410 cooperate with each other in the same manner as do the refill well 160, the piercing member 170 and the docking adaptor 210 described above. Preferably, the refill well 460, the piercing member 470 and the docking adaptor 410 have non-standard dimensions of the type described above so as to provide anti-bootleg protection for the associated dispenser.

While there have been described what at present are considered to be the preferred embodiments of the invention, it will be understood that various modifications may be made therein, and it is intended to cover in the appended claims all such modifications as fall within the true spirit and scope of the invention.

What is claimed is:

1. A fluid refill pouch comprising a flexible encompassing wall sealed to form a hollow flexible container with a quantity of fluid therein, a hollow and generally cylindrically docking adaptor loosely disposed within said pouch, said docking adaptor including a generally cylindrical wall having an outer surface, a plurality of longitudinally extending flutes in said outer surface of said docking adaptor, and at least two drain openings extending through said cylindrical wall, one of said drain openings being positioned in said cylindrical wall adjacent to each of the ends thereof, said flexible encompassing wall being foldable about said docking adaptor to permit a user to grasp said docking adaptor in said flutes to press one end of said docking adaptor against an area of said flexible encompassing wall.

2. The fluid refill pouch set forth in claim 1, wherein said flexible encompassing wall is formed of a flexible plastic.

3. The fluid refill pouch set forth in claim 1, wherein said flexible encompassing wall is formed of a polyethylene plastic having a thickness in the range from about 1 mil to about 5 mils.

4. The fluid refill pouch set forth in claim 1, wherein said tubular docking adaptor is symmetrical about a plane normal to the axis thereof at the midpoint thereof.

5. The fluid refill pouch set forth in claim 1, wherein said longitudinally extending flutes are equidistantly arranged around the perimeter of said tubular docking adaptor and extend the full length thereof.

6. A fluid refill pouch comprising a flexible encompassing wall sealed to form a hollow flexible container with a quantity of fluid therein, and a hollow and generally cylindrical docking adaptor loosely disposed within said pouch, said docking adaptor including a generally cylindrical wall having an outer surface formed by three foils joined at the edges thereof to provide flutes extending longitudinally of said docking adaptor, and at least two drain openings extending through said cylindrical wall, one of said drain openings being positioned in said cylindrical wall adjacent to each of the ends thereof, said flexible encompassing wall being foldable about said docking adaptor to permit a user to grasp said docking adaptor against an area of said flexible encompassing wall.

7. The fluid refill pouch set forth in claim 6, wherein the wall of said docking adaptor is essentially of constant thickness.

8. A fluid refill pouch comprising a flexible encompassing wall sealed to form a hollow flexible container with a quantity of fluid therein, and a hollow and generally cylindrical docking adaptor loosely disposed within said pouch, said docking adaptor including a generally cylindrical wall having an outer surface formed by four foils joined at the edges thereof to provide flutes extending longitudinally of said docking adaptor, and at least two drain openings extending through said cylindrical wall, one of said drain openings being positioned in said cylindrical wall adjacent to each of the ends thereof, said flexible encompassing wall being foldable about said docking adaptor to permit a user to grasp said docking adaptor in said flutes to press one end of said docking adaptor against an area of said flexible encompassing wall.

9. A fluid refill pouch comprising a flexible encompassing wall sealed to form a hollow flexible container with a quantity of fluid therein, and a hollow and generally cylindrical docking adaptor loosely disposed within said pouch, said docking adaptor including a generally cylindrical wall having an outer surface formed by five foils joined at the edges thereof to provide flutes extending longitudinally of said docking adaptor, and at least two drain openings extending through said cylindrical wall, one of said drain openings being positioned in said cylindrical wall adjacent to each of the ends thereof, said flexible encompassing wall being foldable about said docking adpator to permit a user to grasp said docking adaptor in said flutes to press one end of said docking adaptor against an area of said flexible encompassing wall.

10. A refillable fluid dispenser comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, and a piercing member carried by said inner wall and projecting therefrom into said refill well, said inner wall having a refill aperture therethrough providing direct communication between said reservoir and said refill compartment, the inner surface of said side wall having a plurality of longitudinally extending projections thereon extending inwardly toward the associated piercing member and being spaced therefrom a predetermined distance.

11. The refillable fluid dispenser set forth in claim 10, wherein said refill well is disposed substantially centrally of said partition means, said partition means having an upper surface sloping inwardly toward said refill well.

12. The refillable fluid dispenser set forth in claim 10, and further including a vent opening in said partition means for equalizing the pressure in said reservoir and said refill compartment when said pouch is in position in an associated refill compartment.

13. The refillable fluid dispenser set forth in claim 10, wherein said wall structure has an opening therein above said partition means for permitting flow of fluids therethrough thereby to prevent accumulation of fluid in said refill compartment.

14. The refillable fluid dispenser set forth in claim 10, wherein said piercing member is a hollow regular polygon in cross section.

15. The refillable fluid dispenser set forth in claim 14, wherein the outer end of said piercing member is inclined at an angle with respect to the longitudinal axis thereof and terminates at an intersection of two of the walls of said piercing member.

16. The refillable fluid dispenser set forth in claim 10, and further comprising abutments disposed in said refill well on said inner wall and preventing the full insertion of an undersized docking adaptor into said refill well.

17. A refillable fluid dispenser comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, and a piercing member carried by said inner wall and projecting therefrom into said refill well, said inner wall having a refill aperture therethrough providing direct communication between said reservoir and said refill compartment, the inner surface of said side wall being formed by three foils joined at the edges thereof to provide longitudinally extending projections thereon extending inwardly toward the associated piercing member and being spaced therefrom a predetermined distance.

18. The refillable fluid dispenser set forth in claim 17, wherein said piercing member is an equilateral triangle in cross section and has an outer size to fit within said docking adaptor.

19. The refillable fluid dispenser set forth in claim 17, and further comprising abutments disposed in said refill well on said inner wall and preventing the full insertion of an undersized docking adaptor into said refill well.

20. A refillable fluid dispenser comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, and a piercing member carried by said inner wall and projecting therefrom into said refill well, said inner wall having a refill aperture therethrough providing direct communication between said reservoir and said refill compartment, the inner surface of said side wall being formed by four foils joined at the edges thereof to provide longitudinally extending projections thereon extending inwardly toward the associated piercing member and being spaced therefrom a predetermined distance.

21. The refillable fluid dispenser set forth in claim 20, wherein said piercing member is square in cross section.

22. The refillable fluid dispenser set forth in claim 20, and further comprising abutments disposed in said refill well on said inner wall and preventing the full insertion of an undersized docking adaptor into said refill well.

23. A refillable fluid dispenser comprising a closed wall structure defining a vessel, partition means separating said vessel into a lower fluid reservoir and an upper refill compartment, dispensing means carried by said vessel for dispensing fluid from said reservoir, a refill well extending form said partition means into said reservoir and having a side wall and an inner wall closing the end of said side wall extending into said reservoir, and a piercing member carried by said inner wall and projecting therefrom into said refill well, said inner wall having a refill aperture therethrough providing direct communication between said reservoir and said refill compartment, the inner surface of said side wall being formed by five foils joined at the edges thereof to provide longitudinally extending projections thereon extending inwardly toward the associated piercing member and being spaced therefrom a predetermined distance.

24. The refillable fluid dispenser set forth in claim 23, wherein said piercing member is a regular pentagon in cross section.

25. The refillable fluid dispenser set forth in claim 23, and further comprising abutments disposed in said refill well on said inner wall and preventing the full insertion of an undersized docking adaptor into said refill well.

26. A system for dispensing fluid comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, a piercing member carried by said inner wall and projecting therefrom into said refill well, said inner wall having a refill aperture therethrough providing direct communication between said reservoir and said refill compartment, a fluid refill pouch disposed within said refill compartment and including a flexible encompassing wall sealed to form a hollow flexible container with a quantity of fluid therein, and a docking adaptor loosely disposed within said pouch and including a generally cylindrical wall having an outer generally cylindrical surface and an inner generally cylindrical surface, the inner surface of said side wall and the outer surface of said docking adaptor wall being shaped complementary with said docking adaptor wall having an outer size slightly less than the inner size of said side wall so as to fit thereinto with the flexible wall of said pouch disposed within the inner surface of said side wall and the outer surface of said docking adaptor wall, said docking adaptor wall having a plurality of longitudinally extending flutes in the outer surface thereof and said side wall having corresponding projections extending into said flutes, the inner surface of said docking adaptor wall having a size slightly greater than the lateral extent of said piercing member so that a user can grasp said docking adaptor in said flutes to push said docking adaptor into said refill well and over said piercing member, a portion of said flexible wall overlying the end of said docking adaptor as it is inserted into said refill well receiving said piercing member in piercing relationship therethrough so that the contents of said pouch can be emptied into said reservoir through said refill aperture.

27. The system for dispensing fluid set forth in claim 26, wherein said refill well is disposed substantially centrally of said partition means, said partition means having an upper surface sloping inwardly toward said refill well.

28. The system for dispensing fluid set forth in claim 26, and further including a vent opening in said partition means for equalizing the pressure in said reservoir and said refill compartment when said pouch is in position in said refill compartment.

29. The system for dispensing fluid set forth in claim 26, wherein said wall structure has an opening therein above said partition means for permitting flow of fluids therethrough thereby to prevent accumulation of fluid in said refill compartment.

30. The system for dispensing fluid set forth in claim 26, wherein said piercing member is a hollow regular polygon in cross section.

31. The system for dispensing fluid set forth in claim 30, wherein the outer end of said piercing member is inclined at an angle with respect to the longitudinal axis thereof and terminates at an intersection of two of the walls of said piercing member.

32. The system for dispensing fluid set forth in claim 26, and further comprising abutments disposed in said refill well on said inner wall and preventing the full insertion of an undersized docking adaptor into said refill well.

33. A system for dispensing fluid comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, a piercing member carried by said inner wall and projecting therefrom into said refill well, said inner wall having a refill aperture therethrough providing direct communication between said reservoir and said refill compartment, a fluid refill pouch disposed within said refill compartment and including a flexible encompassing wall sealed to form a hollow flexible container with a quantity of fluid therein, and a docking adaptor loosely disposed within said pouch and including a generally cylindrical wall having an outer generally cylindrical surface and an inner generally cylindrical surface, the inner surface of said side wall and the outer surface of said docking adaptor wall being shaped complementary with said docking adaptor wall having an outer size slightly less than the inner size of said side wall so as to fit thereinto with the flexible wall of said pouch disposed within the inner surface of said side wall and the outer surface of said docking adaptor wall, said docking adaptor being formed by three foils joined at the edges thereof to provide flutes extending longitudinally of said docking adaptor and said side wall having corresponding projections extending into said flutes, the inner surface of said docking adaptor wall having a size slightly greater than the lateral extent of said piercing member so that a user can grasp said docking adaptor in said flutes to push said docking adaptor into said refill well and over said piercing member, a portion of said flexible wall overlying the end of said docking adaptor as it is inserted into said refill well receiving said piercing member in piercing relationship therethrough so that the contents of said pouch can be emptied into said reservoir through said refill aperture.

34. The system for dispensing fluid set forth in claim 33, wherein said piercing member is an equilateral triangle in cross section and has an outer size to fit within said docking adaptor.

35. The system for dispensing fluid set forth in claim 34, wherein the outer end of said piercing member is inclined at an angle with respect to the longitudinal axis thereof and terminates at an intersection of two of the walls of said piercing member.

36. The system for dispensing fluid set forth in claim 33, and further comprising abutments disposed in said refill well on said inner wall and preventing full insertion of an undersized docking adaptor into said refill well.

37. A system for dispensing fluid comprising a closed wall structure defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, a piercing member carried by said inner wall and projecting therefrom into said refill well, said inner wall having a refill aperture therethrough providing direct communication between said reservoir and said refill compartment, a fluid refill pouch disposed within said refill compartment and including a flexible encompassing wall sealed to form a hollow flexible container with a quantity of fluid therein, and a docking adaptor loosely disposed within said pouch and including a generally cylindrical wall having an outer generally cylindrical surface and an inner generally cylindrical surface, the inner surface of said side wall and the outer surface of said docking adaptor wall being shaped complementary with said docking adaptor wall having an outer size slightly less than the inner size of said side wall so as to fit thereinto with the flexible wall of said pouch disposed within the inner surface of said side wall and the outer surface of said docking adaptor wall, said docking adaptor being formed by four foils joined at the edges thereof to provide flutes extending longitudinally of said docking adaptor and said side wall having corresponding projections extending into said flutes, the inner surface of said docking adaptor wall having a size slightly greater than the lateral extent of said piercing member so that a user can grasp said docking adaptor in said flutes to push said docking adaptor into said refill well and over said piercing member, a portion of said flexible wall overlying the end of said docking adaptor as it is inserted into said refill well receiving said piercing member in piercing relationship therethrough so that the contents of said pouch can be emptied into said reservoir through said refill aperture.

38. The system for dispensing fluid set forth in claim 37, wherein said piercing member is square in cross section and has an outer size to fit within said docking adaptor.

39. The system for dispensing fluid set forth in claim 38, wherein the outer end of said piercing member is inclined at an angle with respect to the longitudinal axis thereof and terminates at an intersection of two of the walls of said piercing member.

40. The system for dispensing fluid set forth in claim 37, and further comprising abutments disposed in said refill well on said inner wall and preventing the full insertion of an undersized docking adaptor into said refill well.

41. A system for dispensing fluid comprising a closed wall strucutre defining a vessel, partition means separating said vessel into a lower fluid reservoir and an upper refill compartment, dispensing means carried by said vessel for dispensing fluid from said reservoir, a refill well extending from said partition means into said reservoir and having a side wall and an inner wall closing the end of said side wall extending into said reservoir, a piercing member carried by said inner wall and projecting therefrom into said refill well, said inner wall having a refill aperture therethrough providing direct communication between said reservoir and said refill compartment, a fluid refill pouch disposed within said refill compartment and including a flexible encompassing wall sealed to form a hollow flexible container with a quantity of fluid therein, and a docking adaptor loosely disposed within said pouch and including a generally cylindrical wall having an outer generally cylindrical surface and an inner generally cylindrical surface, the inner surface of said side wall and the outer surface of said docking adaptor wall being shaped complementary with said docking adaptor wall having an outer size slightly less than the inner size of said side wall so as to fit thereinto with the flexible wall of said pouch disposed within the inner surface of said side wall and the outer surface of said docking adaptor wall, said docking adaptor being formed by five foils joined at the edges thereof to provide flutes extending longitudinally of said docking adaptor and said side wall having corresponding projections extending into said flutes, the inner surface of said docking adaptor wall having a size slightly greater than the lateral extent of said piercing member so that a user can grasp said docking adaptor in said flutes to push said docking adaptor into said refill well and over said piercing member, a portion of said flexible wall overlying the end of said docking adaptor as it is inserted into said refill well receiving said piercing member in piercing relationship therethrough so that the conents of said pouch can be emptied into said reservoir through said refill aperture.

42. The system for dispensing fluid set forth in claim 41, wherein said piercing member is a regular pentagon in cross section and has an outer size to fit within said docking adaptor.

43. The system for dispensing fluid set forth in claim 42, wherein the outer end of said piercing member is inclined at an angle with respect to the longitudinal axis thereof and terminates at an intersection of two of the walls of said piercing member.

44. The system for dispensing fluid set forth in claim 41, and further comprising abutments disposed in said refill well on said inner wall and preventing the full insertion of an undersized docking adaptor into said refill well.

45. A fluid refill pouch comprising a flexible encompassing wall sealed to form a hollow flexible container with a quantity of fluid therein, a hollow and generally cylindrical docking adaptor loosely disposed within said pouch, said docking adaptor including a generally cylindrical wall having an outer surface, a plurality of longitudinally extending flutes in said outer surface of said docking adaptor, and drain openings extending through said cylindrical wall, said tubular docking adaptor being symmetrical about a plane normal to the axis thereof at the midpoint thereof, said flexible encompassing wall being foldable about said docking adaptor to permit a user to grasp said docking adaptor in said flutes to press one end of said docking adaptor against an area of said flexible encompassing wall.

46. A fluid refill pouch comprising a flexible encompassing wall sealed to form a hollow flexible container with a quantity of fluid therein, a hollow and generally cylindrical docking adaptor loosely disposed within said pouch, said docking adaptor including a generally cylindrical wall having an outer surface, a plurality of longitudinally extending flutes in said outer surface of said docking adaptor, and two drain openings extending through said cylindrical wall respectively disposed adjacent the ends thereof, said drain openings being angularly displaced with respect to each other about the periphery of said docking adaptor, said flexible encompassing wall being foldable about said docking adaptor to permit a user to grasp said docking adaptor in said flutes to press one end of said docking adaptor against an area of said flexible encompassing wall.

47. A fluid refill pouch comprising a flexible encompassing wall sealed to form a hollow flexible container with a quantity of fluid therein, and a hollow and generally cylindrical docking adaptor loosely disposed within said pouch, said docking adaptor including a generally cylindrical wall having an outer surface formed by three foils joined at the edges thereof to provide flutes extending longitudinally of said docking adaptor, and drain openings extending through said cylindrical wall, said tubular docking adaptor being symmetrical about a plane normal to the axis thereof at the midpoint thereof, said flexible encompassing wall being foldable about said docking adaptor to permit a user to grasp said docking adaptor in said flutes to press one end of said docking adaptor against an area of said flexible encompassing wall.

48. A fluid refill pouch comprising a flexible encompassing wall sealed to form a hollow flexible container with a quantity of fluid therein, and a hollow and generally cylindrical docking adaptor loosely disposed within said pouch, said docking adaptor including a generally cylindrical wall having an outer surface formed by three foils joined at the edges thereof to provide flutes extending longitudinally of said docking adaptor, and two drain openings extending through said cylindrical wall respectively disposed adjacent the ends thereof, said drain openings are angularly displaced with respect to each other about the periphery of said docking adaptor, said flexible encompassing wall being foldable about said docking adaptor to permit a user to grasp said docking adaptor in said flutes to press one end of said docking adaptor against an area of said flexible encompassing wall.

* * * * *

UNITED STATES PATENT AND TRADEMARK OFFICE

CERTIFICATE OF CORRECTION

PATENT NO. : 4,576,313

DATED : March 18, 1986

INVENTOR(S) : Randel P. Smith and Robert L. Steiner

It is certified that error appears in the above—identified patent and that said Letters Patent is hereby corrected as shown below:

Claim 9, column 14, line 8, "adpator" should be --adaptor--.

Claim 23, column 15, line 41, "form" should be --from--.

Signed and Sealed this

*Twenty-ninth* Day of *July 1986*

[SEAL]

*Attest:*

*Attesting Officer*

DONALD J. QUIGG

*Commissioner of Patents and Trademarks*